US005237374A

United States Patent [19]

Ueno et al.

[11] Patent Number: 5,237,374

[45] Date of Patent: Aug. 17, 1993

[54] IMAGE FORMING APPARATUS HAVING INTERMEDIATE TRANSFER MEMBER

[75] Inventors: Yukihiko Ueno, Osaka; Yasutaka Maeda; Taisuke Kamimura, both of Nara; Tsuyoshi Miyamoto, Osaka; Hideyuki Nishimura; Kyouichi Takata, both of Nara, all of Japan

[73] Assignee: Sharp Kabushiki Kaisha, Osaka, Japan

[21] Appl. No.: 353,236

[22] Filed: May 17, 1989

[30] Foreign Application Priority Data

May 20, 1988 [JP] Japan ..... 63-124198

[51] Int. Cl.[5] ..... G03G 21/00

[52] U.S. Cl. ..... 355/299; 355/275

[58] Field of Search ..... 355/275, 277, 299, 296, 355/274, 272, 271, 297, 326, 327, 328; 118/652

[56] References Cited

U.S. PATENT DOCUMENTS

| | | | |
|---|---|---|---|
| 4,026,648 | 5/1977 | Takahashi | 355/299 |
| 4,076,564 | 2/1978 | Fisher | 355/299 X |
| 4,078,432 | 3/1978 | Stewart | 250/227.14 X |
| 4,352,549 | 10/1982 | Ozawa | 355/274 X |
| 4,576,468 | 3/1986 | Saito | 355/299 |
| 4,639,123 | 1/1987 | Adachi et al. | 355/299 |
| 4,788,572 | 11/1988 | Slayton et al. | 355/326 |

FOREIGN PATENT DOCUMENTS

| | | | |
|---|---|---|---|
| 0153357 | 11/1981 | Japan | 118/652 |

*Primary Examiner*—A. T. Grimley
*Assistant Examiner*—Robert Beatty

[57] ABSTRACT

An electrophotographic image forming apparatus for transferring a visible toner image formed on a photoconductive body onto an intermediate transfer body primarily and transferring the toner image transferred on the intermediate body onto a paper secondarily is disclosed. In the electrophotographic image forming apparatus, the toner remaining on the photoconductive body is removed by a first cleaner blade after the primary transfer, and the toner remaining on the intermediate transfer body is removed by a second cleaner blade after the secondary transfer. A contact pressure of the second cleaner blade to be applied to the intermediate transfer body is set to be larger than a contact pressure of the first cleaner blade to be applied to the photoconductive body.

2 Claims, 3 Drawing Sheets

IMAGE FORMING APPARATUS HAVING INTERMEDIATE TRANSFER MEMBER

BACKGROUND OF THE INVENTION

1. Field of the Invention

The present invention relates to an electrophotographic image forming apparatus such as an electrostatic transfer type copying machine and laser printer, and more particularly, to an electrophotographic image forming apparatus comprising a cleaning means for cleaning an intermediate transfer body.

2. Description of the Related Art

In a conventional electrostatic transfer type copying machine, there is generally arranged a photoconductive body cleaning means having a cleaner blade for removing developer (referred to as toner hereinafter) remaining on a photoconductive body after a visible toner image formed on the surface of the photoconductive body is transferred onto a copying paper. When the cleaner blade of the cleaning means is contacted onto the surface of the photoconductive body, the toner remaining thereon can be removed.

Recently, there is proposed an electrostatic transfer type full color copying machine comprising an intermediate transfer body onto which respective color toner images are transferred temporarily. In the full color copying machine, respective colors of toner images are transferred sequentially and superimposed on the intermediate transfer body primarily so as to form a full color toner image thereon. Thereafter, the full color toner image is transferred onto a copying paper secondarily.

In the full color copying machine comprising such an intermediate transfer body, after one color toner image formed on the photoconductive body has been transferred onto the intermediate transfer body primarily, the toner remaining on the photoconductive body is removed by a blade type photoconductive body cleaning means.

On the other hand, after the full color toner image superimposed on the intermediate transfer body has been transferred onto a copying paper secondarily, the toner may remain on the intermediate transfer body. When the intermediate transfer body is left as it is, the quality of the image to be transferred onto the copying paper is lowered due to the residual toner. Therefore, it is necessary to comprise a cleaning means for removing the toner remaining on the intermediate transfer body.

In a conventional full color copying machine, a cleaner brush is provided as the cleaning means for cleaning the intermediate transfer body. Therefore, a relatively large space is needed for arranging the cleaning means. Also, since the toner tends to adhere to the cleaner brush, it is necessary to scrape off the toner often. Furthermore, it is necessary to remove the toner scraped off by using an absorption apparatus etc., resulting in that the copying machine comprising the cleaner brush inevitably becomes bulky.

For example, it is considered that another cleaner blade having an essentially same composition as that of the cleaner blade for cleaning the photoconductive body is used as the cleaning means for cleaning the intermediate transfer body. However, it is found out that the following problems are caused when another cleaner blade is used as the cleaning means for cleaning the intermediate transfer body.

Namely, in order to avoid damages of the photoconductive body due to the contact of the cleaner blade thereto, the photoconductive body is made of an organic photoconductive conductor so that the surface thereof is not marred by the cleaner blade, and the surface thereof is finished in a mirror-like smooth surface state so that the residual toner can be scraped off therefrom easily and the toner image formed thereon can be transferred easily. As a result, since the cleaner blade removes the toner remaining on the surface of the photoconductive body by slidably contacting to the mirror-like smooth surface thereof, the contact pressure of the cleaner blade to the photoconductive body is set at a relatively low value generally. And, the friction coefficient between the cleaner blade and the surface of the photoconductive body is set at a relatively small value of about 1.0 so that the toner can be surely removed.

However, when the cleaner blade having an essentially same composition as that of the cleaner blade for cleaning the photoconductive body is used as the cleaning means for cleaning the intermediate transfer body, the cleaning performance for cleaning the intermediate transfer body is lowered considerably, and the cleaner blade tends to be reversed according to the movement of the intermediate transfer body. Furthermore, a large friction is caused on the edge portion of the cleaner blade. Therefore, a stable cleaning performance for cleaning the intermediate transfer body can not be obtained.

SUMMARY OF THE INVENTION

An essential object of the present invention is to provide an electrophotographic image forming apparatus comprising a cleaner blade which is able to clean an intermediate transfer body with a stable and improved cleaning performance, without being reversed according to the movement of the intermediate transfer body.

According to the present invention, there is provided an electrophotographic image forming apparatus comprising: image formation means for forming an electrostatic latent image corresponding to an image of a document on an photoconductive body; development means for developing the electrostatic latent image formed on said photoconductive body in a visible toner image with toner; primary transfer means for transferring the visible toner image formed on said photoconductive body onto an intermediate transfer body having a larger roughness of the surface than that of said photoconductive body; secondary transfer means for transferring the toner image transferred on said intermediate transfer body onto a paper; first cleaner blade for removing the toner remaining on said photoconductive body by slidably contacting thereto after the visible toner image is transferred onto said intermediate transfer body by said primary transfer means; and second cleaner blade for removing the toner remaining on said intermediate transfer body by slidably contacting thereto after the toner image is transferred onto said paper by said secondary transfer means; wherein a contact pressure of said second cleaner blade to be applied to said intermediate transfer body is set to be larger than a contact pressure of said first cleaner blade to be applied to said photoconductive body.

BRIEF DESCRIPTION OF THE DRAWINGS

These and other objects and features of the present invention will become clear from the following description taken in conjunction with the preferred embodiments thereof with reference to the accompanying drawings, in which.

DETAILED DESCRIPTION OF THE PREFERRED EMBODIMENT

An electrostatic transfer type full color copying machine of the preferred embodiment according to the present invention will be described hereinafter, referring to the attached drawings.

Figure 1:
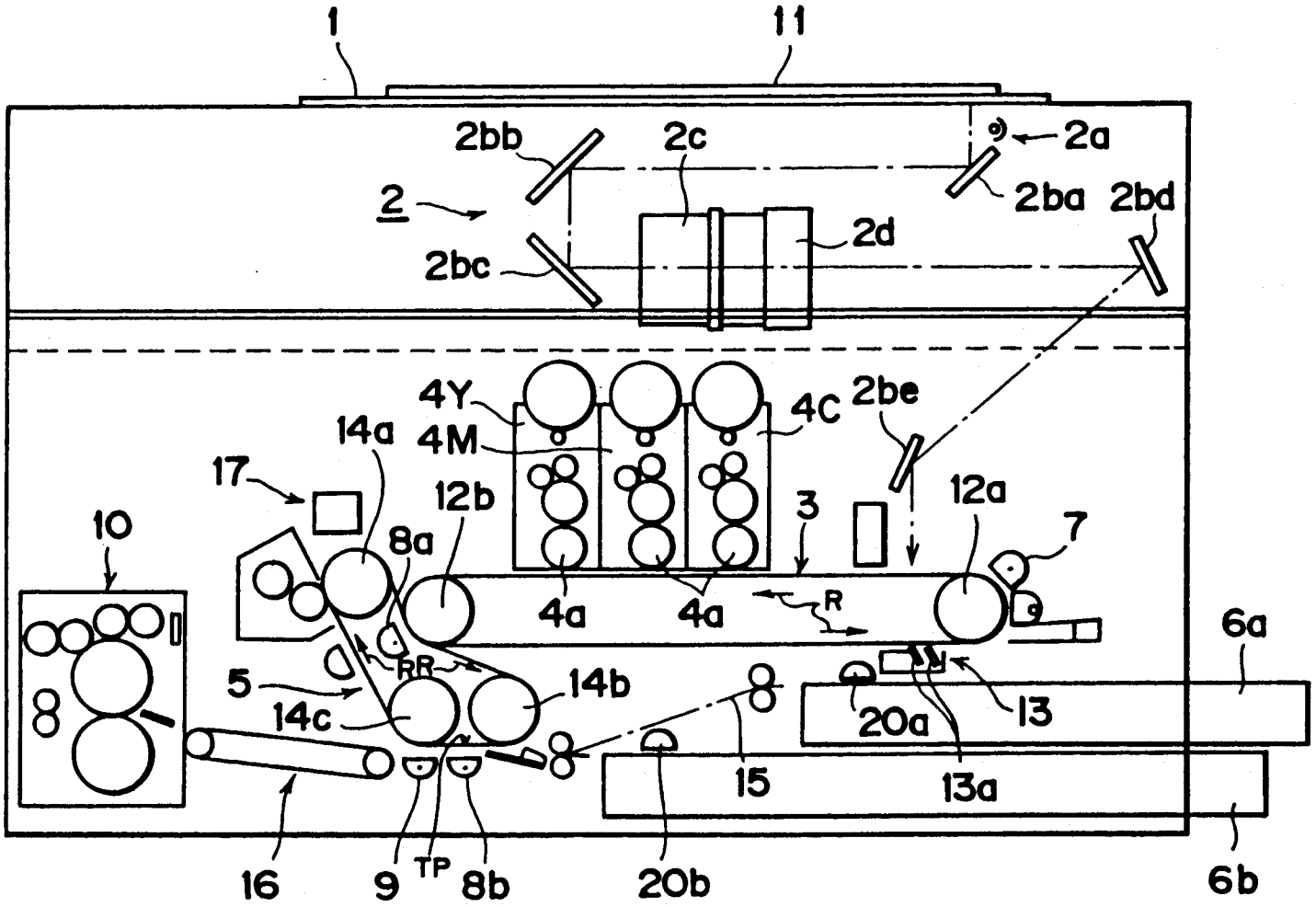
FIG. 1 is a schematic longitudinal cross sectional view showing the whole composition of an electrostatic transfer type full color copying machine of the preferred embodiment according to the present invention.

In FIG. 1, a document table 1 of, for example, transparent glass plate for setting a document 11 thereon is arranged on the upper surface of the full color copying machine. Under the document table 1, there is arranged an exposure optical system 2 for exposing a photoconductive belt 3 so as to form an electrostatic latent image corresponding to the image of the document 11 thereonto.

The exposure optical system 2 comprises a light source lamp 2*a* for illuminating the document 11 arranged on the document table 1, five reflection mirrors 2*ba* to 2*be* for reflecting a light reflected from the document 11 so as to guide it to the surface of the photoconductive belt 3, a focus lens 2*c* for focusing a light reflected from the reflection mirror 2*bc* onto the reflection mirror 2*bd* through a color filter 2*d*, and the color separating filter 2*d* having color filters for filtering primary colors of lights such as red, green and blue lights, respectively.

The photoconductive belt 3 is made of an organic photoconductive conductor, and the surface thereof is finished in a mirror-like smooth surface state in order to adhere toner thereon easily and transfer a toner image formed thereon onto another surface easily. The photoconductive belt 3 is of a looped endless sheet shape, and is tensed by first and second rollers 12*a* and 12*b* and is rotated in a direction indicated by arrows R as shown in FIG. 1.

Three developing units 4Y, 4M and 4C are arranged just above the upper run of the photoconductive belt 3 without contacting thereto. These developing units 4Y, 4M and 4C supply yellow, magenta and cyan toners to the surface of the photoconductive belt 3, wherein yellow, magenta and cyan are complemental to respective colors of the color separating filter 2*d*, respectively. Respective developing units 4Y, 4M and 4C comprise a magnet roller 4*a* for supplying a toner onto the surface of the photoconductive belt 3 on which an electrostatic latent image has been formed thereon by the exposure optical system 2. Respective developing units 4Y, 4M and 4C also comprise a shutter member (not shown) capable of opening and closing a window (not shown) supplying the toner onto the surface of magnet roller 4*a* arranged so as to face the upper run of the photoconductive belt 3.

On the other hand, under the first roller 12*a*, there is arranged a photoconductive belt cleaning means 13 for removing the toner remaining on the surface of the photoconductive belt 3. The photoconductive belt cleaning means 13 comprises a cleaner blade 13*a*. When the cleaner blade 13*a* is slidably pressed onto the surface of the photoconductive belt 3, the residual toner can be removed. The cleaner blade 13*a* is arranged in the opposite direction to the running direction of the photoconductive belt 3 at a contact angle to the photoconductive belt 3 which is defined to the tangent of the photoconductive belt 3 at the contact point thereof. Since the surface of the photoconductive belt 3 is formed in a mirror-like smooth surface state, a high friction coefficient can be obtained even though the cleaner blade 13*a* is contacted thereto with a relatively low contact pressure, resulting in that the toner remaining on the surface of the photoconductive belt 3 can be removed completely. It is to be noted that the friction coefficient between the surface of the photoconductive belt 3 and the cleaner blade 13*a* is set at about 1.0.

Just below the lower run of the photoconductive belt cleaning means 13 and near the first roller 12*a*, there is arranged a corona charger 7 for electrifying the surface of the photoconductive belt 3.

On the other hand, an intermediate transfer belt 5 having a looped endless sheet shape is tensed by first, second and third transfer rollers 14*a*, 14*b* and 14*c*, and is rotated in a direction indicated by arrows RR as shown in FIG. 1. Furthermore, the intermediate transfer belt 5 is pressed onto the portion of the photoconductive belt 3 running around the second roller 12*b*. Inside of the running portion of the intermediate transfer belt 5 as indicated by the arrows RR in FIG. 1 which is pressed onto the photoconductive belt 3, there is arranged a corona charger 8*a* for sequentially transferring respective color toner images formed on the surface of the photoconductive belt 3 onto the intermediate transfer belt 5. Furthermore, under the lower running portion of the intermediate transfer belt 5, there are arranged a transfer charger 8*b* for transferring a visible toner image transferred on the intermediate transfer belt 5 onto a copying paper 15, and a separating charger 9 for separating the copying paper 15 from the intermediate transfer belt 5.

Under the first roller 12*a*, there are arranged two paper feeding cassettes 6*a* and 6*b* for accommodating different sizes of copying papers 15, respectively. Paper feeding rollers 20*a* and 20*b* having a half moon shape for sequentially feeding the copying paper 15 accommodated in the paper feeding cassettes 6*a* and 6*b* are arranged above the paper feeding cassettes 6*a* and 6*b*, respectively. A transportation belt 16 for transporting the copying paper 15 separated by the charger 9 to a fixing unit 10 is arranged along the transportation path of the copying paper 15. The fixing unit 10 including fixing rollers for fixing a visible toner image transferred on the copying paper 15 is arranged next to the transportation belt 16.

The toner remaining on the photoconductive belt 3 is removed by the photoconductive belt cleaning means 13 after each transfer of color toner images.

On the other hand, a blade type intermediate transfer belt cleaning means 17 having an essentially same composition as that of the photoconductive belt cleaning means 13 is arranged above the intermediate transfer belt 5, and the toner remaining on the intermediate transfer belt 5 is removed by the intermediate transfer belt cleaning means 17.

Figure 2:
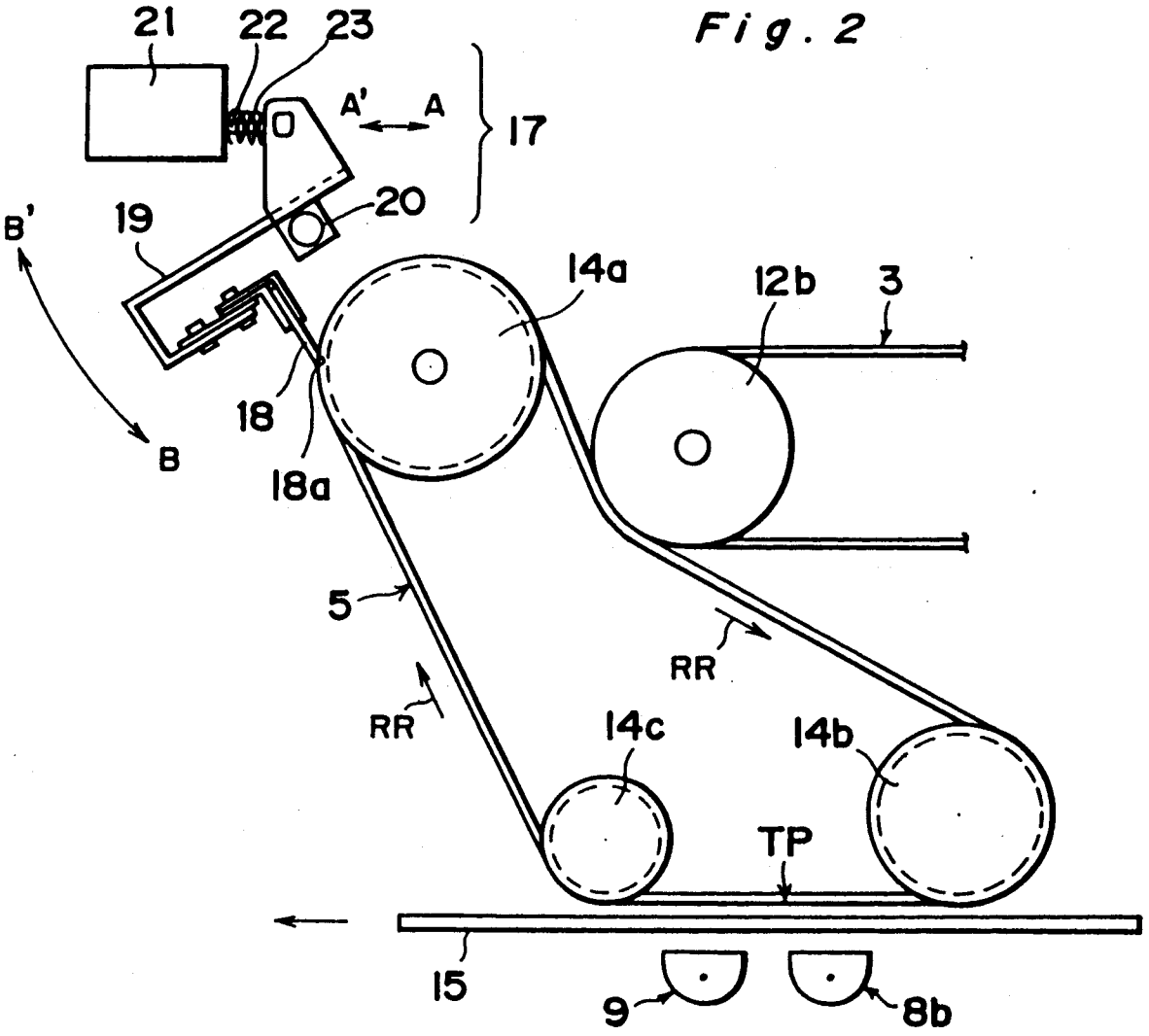
FIG. 2 is an enlarged schematic longitudinal cross sectional view of the main portion of the full color copying machine shown in FIG. 1 showing an intermediate transfer belt being cleaned by a cleaning means.

As shown in FIG. 2, the intermediate transfer belt cleaning means 17 comprises a cleaner blade 18 having a rectangular shape made of an elastic elastomer material such as polyurethane, a supporting arm 19 for supporting the cleaner blade 18, and an electromagnetic solenoid 21 for swinging the supporting arm 19 in opposite directions indicated by arrows B and B' around a supporting axis 20.

The cleaner blade 18 is arranged near the first transfer roller 14a so as to press the intermediate transfer belt 5 on the surface of the first transfer roller 14a. Namely, it scrapes off the remaining toner on the belt 5 which was not transferred to the copying paper 15 at a transfer position TP defined between the second and third transfer rollers 14b and 14c. In order to enhance the efficiency of the scraping off the toner by the cleaner blade 18, the latter is supported in the tangential direction of the belt 5 running about the first transfer roller 14a by a predetermined angle.

Figure 3:
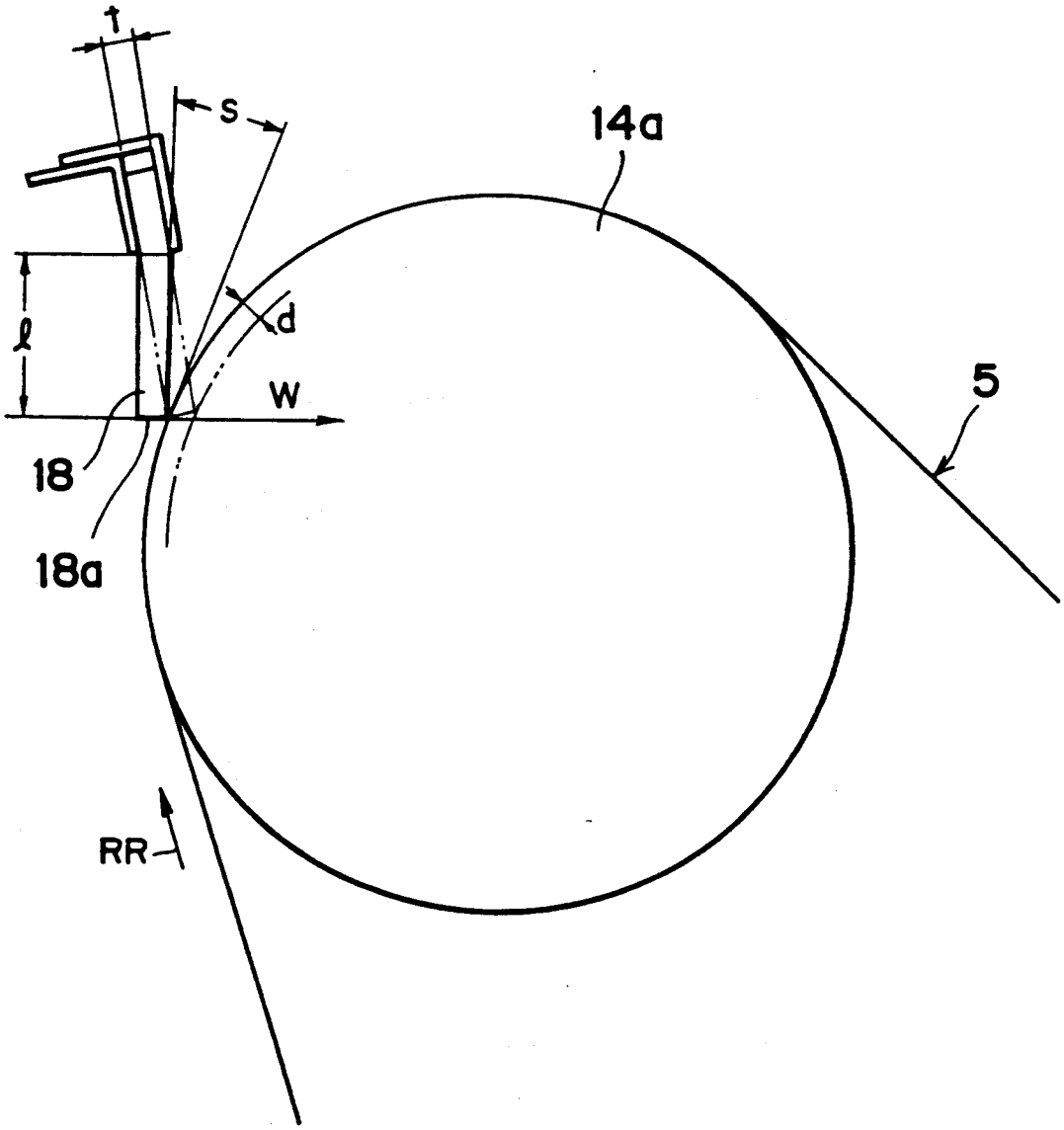
FIG. 3 is an enlarged schematic longitudinal cross sectional view showing the cleaning means for cleaning the intermediate transfer belt.

More concretely, as shown in FIG. 3, a contact angle s of the cleaner blade 18 to the intermediate transfer belt 5 which is defined to the tangent of the intermediate transfer belt 5 at the contact point thereof is set at such an acute angle that it is smaller than that of the cleaner blade 13a to the photoconductive belt 3. Preferably, the contact angle s of the cleaner blade 18 to the intermediate transfer belt 5 is set at a value equal to or larger than 10° and smaller than 20°, however, it is not limited within this range.

Further, the cleaner blade 18 is formed, so that the thickness t thereof is larger than that of the cleaner blade 13a, and a quotient of the thickness t of the cleaner blade 18 divided by a projection length l thereof as defined in FIG. 3 is larger than that of the cleaner blade 13a. Furthermore, the projection length l of the cleaner blade 18 is preferably smaller than that of the cleaner blade 13a. Furthermore, a bite depth d of the cleaner blade 18 into the intermediate transfer belt 5 as defined in FIG. 3 is set to be larger than that of the cleaner blade 13a into the photoconductive belt 3. The Young's modulus E of the cleaner blade 18 is set to be larger than that of the cleaner blade 13a.

When various conditions are set separately as described above, as will be explained later in detail, the contact pressure of the cleaner blade 18 to be applied to the intermediate transfer belt 5 is increased, resulting in that the toner remaining on the intermediate transfer belt 5 can be removed certainly, and the cleaner blade 18 can be prevented from being reversed in the running direction of the intermediate transfer belt 5. Furthermore, the abrasion of the edge portion 18a of the cleaner blade 18 is decreased, and a stable cleaning performance thereof for cleaning the intermediate transfer belt 5 can be obtained.

In order to stabilize the cleaning performance of the cleaner blade 18, the intermediate transfer belt 5 is made of a material having a predetermined electric resistive value and a smooth surface, such as aramid (aromatic polyamide). Since it is difficult to form the surface of the intermediate transfer belt 5 in a mirror-like smooth surface state when the intermediate transfer belt 5 is made of aramid, the surface of the intermediate transfer belt 5 is formed in a relatively rougher surface state than that of the photoconductive belt 3.

However, when various conditions of the cleaner blade 18 are satisfied separately as described above, the contact pressure of the cleaner blade 18 to be applied to the intermediate transfer belt 5 can be increased (the friction coefficient is approximately 0.7), and the abrasion of the edge portion 18a of the cleaner blade 18 can be decreased. Furthermore, the cleaner blade 18 can be prevented from being reversed at an initial stage when the cleaner blade 18 is slidably contacted to the intermediate transfer belt 5, resulting in that the cleaning performance thereof for cleaning the intermediate transfer belt 5 can be stabilized.

As shown in FIG. 2, when the power is supplied to the electromagnetic solenoid 21, an acting member 22 thereof is moved forward in a direction indicated by an arrow A with an elastic return force of a coil spring 23. On the other hand, when the power is not supplied thereto, the acting member 22 is moved backward in a back direction indicated by an arrow A'. When the acting member 22 of the electromagnetic solenoid 21 is moved backward in the direction indicated by the arrow A', the supporting arm 19 connected to the acting member 22 is rotated by a predetermined angle in the direction indicated by the arrow B around the supporting axis 20. Therefore, the cleaner blade 18 is slidably contacted to the surface of the intermediate transfer belt 5 which is wound around the first transfer roller 14a.

Furthermore, while respective color toner images formed on the photoconductive belt 3 are transferred onto the intermediate transfer belt 5 primarily during copying, the cleaner blade 18 is separated from the intermediate transfer belt 5, and then, the toner images to be transferred thereonto remain on the intermediate transfer belt 5. On the other hand, after a full color toner image transferred on the intermediate transfer belt 5 is transferred onto a copying paper 15, the cleaner blade 18 is pressed onto the intermediate transfer belt 5 at a predetermined timing. This timing is controlled by a control circuit (not shown).

It is to be noted that the composition, for switching over the position of the cleaner blade 18 of the intermediate transfer belt cleaning means 17 between such a contact state that it is pressed on the intermediate transfer belt 5 and such a non-contact state that it is separated from the intermediate transfer belt 5, is not limited to that of the present preferred embodiment.

The material of the intermediate transfer belt 5 is not limited to aramid, and it may be polyvinyl fluoride (trade name:Tedlar), polyimide (trade name:Kapton), polyvinylidene fluoride (trade name:Kynar), polycarbonate, polyethylene terephthalate (PET) etc..

As described above, the contact pressure W (See FIG. 3) of the cleaner blade 18 to be applied to the intermediate transfer belt 5 is set to be larger than the contact pressure of the cleaner blade 13a of the cleaning means 13 to be applied to photoconductive belt 3 for removing the toner remaining on the, photoconductive belt 3. In the case that the intermediate transfer belt cleaning means 17 is constituted by the leading type cleaner blade 18 as shown in FIG. 3, parameters for expressing the contact pressure W of the cleaner blade 18 are as follows. It is to be noted that, in the case that the end edge portion 18a of the cleaner blade 18 is formed in a line shape, the contact pressure W of the cleaner blade 18 to be applied to the surface of the intermediate transfer belt 5 becomes a line pressure.

(1) t : Thickness of the cleaner blade 18

(2) l : Projection length of the cleaner blade 18

(3) d : Bite depth of the cleaner blade 18 in which it bites the intermediate transfer belt 5 actually (4) E : Young's modulus of the cleaner blade 18

Assuming that the cleaner blade 18 made of an elastomer material is considered as a flat spring, the contact pressure W in the vertical direction to be applied to the intermediate transfer belt 5 can be expressed by the following equation from the formula of cantilever spring.

$$W = d\,E\,t^3 / 4\,l^3 \quad (1)$$

Accordingly, in order to increase the contact pressure W of the cleaner blade 18 so that the intermediate transfer belt 5 can be cleaned in a high cleaning performance, the aforementioned parameters t, l, d and E are set so that the contact pressure W of the cleaner blade 18 is larger than that of the cleaner blade 13*a* of the photoconductive belt cleaning means 13.

That is, when the cleaner blade 18 is formed so that the thickness t thereof is larger than that of the cleaner blade 13*a* of the photoconductive belt cleaning means 13, the contact pressure W of the cleaner blade 18 to be applied to the intermediate transfer belt 5 becomes larger than that of the cleaner blade 13*a* to be applied to the photoconductive belt 3.

Similarly, when the quotient of the thickness t of the cleaner blade 18 divided by the projection length l thereof is set to be larger than that of the cleaner blade 13*a* of the photoconductive belt cleaning means 13, the contact pressure W of the cleaner blade 18 to be applied to the intermediate transfer belt 5 becomes larger than that of the cleaner blade 13*a* to be applied to the photoconductive belt 3. As is apparent from the aforementioned equation (1), since the contact pressure W is directly proportional to the cube of the thickness t and is inversely proportional to the cube of the projection length l, the value t / l of the cleaner blade 18 is set to be larger than that of the cleaner blade 13*a* so that the contact pressure W of the cleaner blade 18 can be larger than that of the cleaner blade 13*a*.

Furthermore, similarly, when the projection length l of the cleaner blade 18 is smaller than that of the cleaner blade 13*a*, the contact pressure W of the cleaner blade 18 to be applied to the intermediate transfer belt 5 becomes larger than that of the cleaner blade 13*a* to be applied to the photoconductive belt 3.

In our experiment, the projection length l of the cleaner blade 13*a* is set at 12 mm and the projection length l of the cleaner blade 18 is set at 10 mm. According to the result of our experiment, a high cleaning performance of the cleaner blade 18 for cleaning the intermediate transfer belt 5 can be obtained.

Furthermore, similarly, the bite depth d of the cleaner blade 18 in which the cleaner blade 18 bites the intermediate transfer belt 5 is set to be larger than that of the cleaner blade 13*a* of the photoconductive belt cleaning means 13 in which the cleaner blade 13*a* bites the photoconductive belt 3, the contact pressure W of the cleaner blade 18 to be applied to the intermediate transfer belt 5 becomes larger than that of the cleaner blade 13*a* to be applied to photoconductive belt 3.

Furthermore, similarly, the Young's modulus E of the cleaner blade 18 is set to be larger than that of the cleaner blade 13*a* of the photoconductive belt cleaning means 13, the contact pressure W of the cleaner blade 18 to be applied to the intermediate transfer belt 5 becomes larger than that of the cleaner blade 13*a* to be applied to the photoconductive belt 3.

Furthermore, when the cleaner blade 18 is arranged in the opposite direction to the running direction of the intermediate, transfer belt 5 and the acute angle s at which the cleaner blade 18 meets the intermediate transfer belt 5 is set to be larger than that at which the cleaner blade 13*a* meets the photoconductive belt 3, the contact pressure W of the cleaner blade 18 to be applied to the intermediate transfer belt 5 becomes larger than that of the cleaner blade 13*a* to be applied to the photoconductive belt 3, and also the abrasion of the edge portion of the cleaner blade 18 can be decreased.

That is, the contact pressure W of the cleaner blade 18 is a force which the cleaner blade 18 gives the intermediate transfer belt 5 in the vertical direction, and the vertical reaction force of the intermediate transfer belt 5 can be obtained from another experiment. Parameters for calculating the aforementioned vertical reaction force are considered to be the set angle s at which the cleaner blade 18 meets the intermediate transfer belt 5, and the friction coefficient between the cleaner blade 18 and the intermediate transfer belt 5. If the friction coefficient is a constant since the friction coefficient is related to the materials of the intermediate transfer belt 5 and the cleaner blade 18, it is found out that the set angle s at which the cleaner blade 18 meets the intermediate transfer belt 5 is directly proportional to the rotation torque of the intermediate transfer belt 5. Accordingly, larger the set angle s at which the cleaner blade 18 meets the intermediate transfer belt 5 is, larger the rotation torque is. The rotation torque divided by the friction coefficient becomes the vertical reaction force of the intermediate transfer belt 5. Therefore, in order to improve the cleaning performance of the cleaner blade 18 for cleaning the intermediate transfer belt 5, it is necessary to set the vertical reaction force of the intermediate transfer belt 5 so as to be larger than that of the photoconductive belt 3. According to this judgment, the set angle s at which the cleaner blade 18 meets the intermediate transfer belt 5 is set to be larger than that at which the cleaner blade 13*a* meets the photoconductive belt 3.

Accordingly, in the present preferred embodiment, a high cleaning performance of the cleaner blade 18 for the cleaning intermediate transfer belt 5 can be obtained.

The operation of the full color copying machine constructed as described above will be described hereinafter.

When a print switch (not shown) is turned on, the document 11 set on the document table 1 is illuminated by the light source lamp 2*a*, and the document 11 is scanned in a horizontal direction three times. The light reflected on the document 11 is incident onto the color separating filter 2*d* through the reflection mirrors 2*ba* to 2*bc* and the focus lens 2*c*, and respective color images of the light are filtered by the color separating filter 2*d*, respectively.

On the other hand, the photoconductive belt 3 is driven by the first and second rollers 12*a* and 12*b* so as to run in the direction indicated by the arrows R, and the surface thereof is electrified uniformly by the corona charger 7. Respective color images transmitted through respective color filters of the color separating filter 2*d* corresponding to the aforementioned respective scan operations are formed on the surface of the photoconductive belt 3 sequentially so as to form the corresponding electrostatic latent images thereon. Respective color electrostatic latent images formed thereon sequentially thus are developed sequentially into visible toner images with the yellow, magenta and cyan toners supplied respectively by the yellow, magenta and cyan developing units 4Y, 4M and 4C. In the primary transfer process, the visible toner images formed on the photoconductive belt 3 are transferred onto the intermediate transfer belt 5 by the transfer corona charger 8*a*, sequentially. On the other hand, the toner remaining on the photoconductive belt 3 after the toner images formed thereon are transferred onto the intermediate transfer belt 5 is removed by the cleaner blade 13*a* of the photoconductive belt cleaning means 13.

As described above, in the primary transfer process, when respective colors of toner images formed on the photoconductive belt 3 are transferred onto the intermediate transfer belt 5 sequentially so as to superimpose them thereon, a full color toner image comprised of respective colors of toner images is formed thereon. Furthermore, in the secondary transfer process, the full color toner image is transferred by the transfer corona charger 8*b* onto a copying paper 15 fed from the selected one of the paper feeding cassettes 6*a* and 6*b*. On the other hand, the toner remaining on the intermediate transfer belt 5 is removed by the cleaner blade 18 of the intermediate transfer belt cleaning means 17. Then, since the contact pressure of the cleaner blade 18 to be applied to the intermediate transfer belt 5 is set to be larger than that of the cleaner blade 13*a* to be applied to the photoconductive belt 3 as described above, a stable high cleaning performance thereof for cleaning the intermediate transfer belt 5 can be obtained, and also the cleaner blade 18 can be prevented from being reversed.

After the full color toner image formed on the intermediate transfer belt 5 is transferred onto the copying paper 15, the copying paper 15 is separated from the intermediate transfer belt 5 by the separating charger 9, and the copying paper 15 is transported to the fixing unit 10 by the transportation belt 16. Finally, the full color image transferred on the copying paper 15 is fixed by the fixing unit 10.

It is understood that various other modifications will be apparent to and can be readily made by those skilled in the art without departing from the scope and spirit of the present invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which the present invention pertains.

What is claimed is:

1. An electrophotographic image forming apparatus comprising:

image formation means for forming an electrostatic latent image corresponding to an image of a document on a photoconductive body;

development means for developing said electrostatic latent image formed on said photoconductive body into a visible toner image with toner;

primary transfer means for transferring said toner image formed on said photoconductive body onto an intermediate transfer body having a surface roughness greater than that of said photoconductive body;

secondary transfer means for transferring said toner image transferred onto said intermediate transfer body onto a paper;

a first cleaner blade for removing the toner remaining on said photoconductive body by slidably contacting thereto after said toner image is transferred onto said intermediate transfer body by said primary transfer means, said first cleaner blade being arranged in the opposite direction to a running direction of said photoconductive body at a first acute angle; and a second cleaner blade for removing the toner remaining on said intermediate transfer body by slidably contacting thereto after said toner image is transferred onto said paper by said secondary transfer means, said second cleaner blade being arranged in the opposite direction to a running direction of said intermediate transfer body at a second acute angle;

wherein a second contact pressure of said second cleaner blade to be applied to said intermediate transfer body is set to be larger than a first contact pressure of said first cleaner blade to be applied to said photoconductive body.

2. An electrophotographic image forming apparatus comprising:

image formation means for forming an electrostatic latent image corresponding to an image of a document on a photoconductive body;

development means for developing said electrostatic latent image formed on said photoconductive body into a visible toner image with toner;

primary transfer means for transferring said toner image formed on said photoconductive body onto an intermediate transfer body having a surface roughness greater than that of said photoconductive body;

secondary transfer means for transferring said toner image transferred onto said intermediate transfer body onto a paper;

a first cleaner for removing the toner remaining on said photoconductive body by slidably contacting thereto after said toner image is transferred onto said intermediate transfer body by said primary transfer means, said first cleaner blade being arranged in the opposite direction to a running direction of said photoconductive body at a first acute angle; and a second cleaner blade for removing the toner remaining on said intermediate transfer body by slidably contacting thereto after said toner image is transferred onto said paper by said secondary transfer means, said second cleaner blade being arranged in an opposite direction to a running direction of said intermediate transfer body at a second acute angle;

wherein a contact pressure W of said second cleaner blade to be applied to said intermediate transfer body is set to be larger than a first contact pressure of said first cleaner blade to be applied to said photoconductive body, said contact pressure W of said second cleaner blade being represented by the following equation:

$$W = dEt^3 / 4l^3,$$

where t is a thickness of said second cleaner blade between a fixed point thereof and an end point thereof;

l is a projection length of said second cleaner blade between said fixed point and said end point thereof;

d is a bite depth of said second cleaner blade in which said second cleaner blade bites said intermediate transfer body; and E is a Young's modulus of said second cleaner blade.

* * * * *